United States Patent [19]

Lanscioni

[11] Patent Number: 4,639,947

[45] Date of Patent: Feb. 3, 1987

[54] GOLF GLOVE

[76] Inventor: Richard Lanscioni, 1310 Oxford Rd., Deerfield, Ill. 60015

[21] Appl. No.: 693,272

[22] Filed: Jan. 17, 1985

[51] Int. Cl.[4] ..... A41D 19/00

[52] U.S. Cl. ..... 2/161 A

[58] Field of Search ..... 2/161 A, 162, 158, 159, 2/160; 36/136, 127

[56] References Cited

U.S. PATENT DOCUMENTS

| | | | |
|---|---|---|---|
| Re. 31,538 | 3/1984 | Antonious | 2/161 A |
| 1,154,122 | 9/1915 | Kovesy | 2/160 |
| 1,374,257 | 4/1921 | Van Raalte | 2/160 |
| 1,612,055 | 12/1926 | Rice | 2/162 |
| 3,588,917 | 6/1971 | Antonious | 2/161 A |
| 4,040,126 | 8/1977 | Cecil | 2/161 A |
| 4,387,838 | 6/1983 | Jackson | 2/160 |
| 4,453,275 | 6/1984 | Kawada | 2/161 A |
| 4,489,444 | 12/1984 | Graham | 2/161 A |

*Primary Examiner*—Louis K. Rimrodt
*Assistant Examiner*—Joseph S. Machuga
*Attorney, Agent, or Firm*—Robert E. Wagner; Ralph R. Rath

[57] ABSTRACT

A golf glove including a main body having a palm portion and a back portion with a fastener means interconnecting segments of the back portion and defining retaining means for a ball marker. The fastener means includes first and second layers peripherally interconnected to define a pocket therebetween and a cut-out produces a closure for gaining access to the pocket. The fastener or flap is connected to the main body through an elastic member that is inserted between the two layers of the flap and connected to the main body, while one layer of the flap is in the form of a fastener element that cooperates with a second fastener element secured to the main body of the golf glove.

12 Claims, 7 Drawing Figures

GOLF GLOVE

TECHNICAL FIELD

The present invention relates generally to golf gloves and, more particularly, to a modification of a golf glove to incorporate a retainer means for holding a ball marker when not being used.

BACKGROUND PRIOR ART

Various accessories have become common in the game of golf, such as tees, green markers and repair tools for use in repairing divots, particularly on the greens. Green or ball markers are usually constructed to be as small as possible to prevent interference with a ball during its path of travel to the cup and also not be a visual obstruction to another golfer when lining up a putt.

One of the most common type of marker that is used extensively in the game today consists of a molded plastic thin circular disc that has a small projection extending from one surface thereof, which is adapted to penetrate the ground so that the marker will remain in a fixed position and will also remain very close to the ground in the event that the path of travel of another golfer's ball passes over the marker. While such markers have become very common, no special means has been developed for storing the marker when not in use, and conventionally the marker is placed in a pocket among various other items and becomes very difficult to find. This is particularly true since most players usually play golf in light clothes in which the pockets are few and are filled with various items necessary for the game, such as scorecards, pencils, hankerchiefs, tees, balls, etc. This makes it very difficult to locate such a small item as a marker within the pocket and not only causes delay in the game, but may also become an irritation when the marker projection inadvertently pierces the golfer's body.

One other type of marker that has been used extensively is incorporated into the golf glove as part of a conventional snap-fastening securing means for retaining the glove on the user's hand during play. Such conventional snap-fastener consists of two snap-fastener elements that are respectively secured to segments of the back portion of the golf glove, which is then used to retain the glove on the hand. Since the exposed fastener element already has a recess or circular opening therein, the ball marker is designed to snap-fit into this circular opening and can thus be exposed at all times for easy removal and placement onto the green to mark the ball. However, to prevent any obstruction, such markers are usually extremely small and, in many instances, may be left on the green unintentionally or dropped prior to being replaced into the holder and, thus, become separated from the glove indefinitely.

Various other storage positions for ball markers have been suggested and are used by golfers for the conventional molded plastic ball marker, such as the slits in the flaps, which are included as part of many golf shoes; separate items of attachment to the golf bag or golf carts which will hold markers, along with tees and other accessories; or separate accessories that may be attached to the clothing of the golfer, so that the items are readily accessible without the necessity of the golfer returning to his bag.

With the increased use of a well-known separate fastener material such as commercially available under the trademark of "Velcro®" fastener or the like, the incorporation of the ball marker into the glove has been, to a large measure, abandoned and the use of the plastic molded marker with a projection has become very common throughout the game.

Of course, various other accessories items have been developed, such as combinations of a repair tool with places for markings which can be carried as a clip within the pocket and because of its size is easily retrievable even when various other items are in the same pocket. However, these again require the golfer to remember to have such separate accessories readily available when commencing the round. Thus, there still remains a need for a retainer means for holding a ball marker that is at all times with the golfer and is easily accessible without any delay in play and without any loss of the marker.

SUMMARY OF THE INVENTION

The retainer means of the present invention is incorporated into a conventional golf glove that has a main body defining a palm portion and a back portion with the back portion being split into sections or segments to accommodate a user's hand and having a flap on one segment securable to the other segment to retain the glove on the user's hand. According to the present invention, the retainer means for the marker is incorporated into the conventional flap which has the conventional Velcro® fastener element as a part thereof which is attached to another Velcro® fastener element secured to the adjacent segment of the glove.

In its preferred form, the flap or fastener means for the golf glove is formed in two separate layers that are peripherally interconnected by a suitable means, such as stitching, and one of the layers has a cut therein which defines a closure for a pocket that is defined between the two layers of the flap. The closure is preferably connected by an integral hinge to the remainder of the layer of the flap, defined by the uncut portion, and the closure preferably has a retaining means on a section spaced from the integral hinge.

According to a further aspect of the invention, the flap is connected to the main body of the glove through an elastic member that extends from the main body between the two layers and is connected thereto by the peripheral interconnection between the layers.

One of the two layers of the flap is preferably a Velcro® connector or fastener element, while a corresponding Velcro® fastener element is secured to the exposed portion of the back portion of the golf glove. Thus, the flap or fastener means for the glove has an integral pocket associated therewith which remains covered through a closure that is an integral part of the material for the flap and can easily be opened for gaining access to the pocket that can receive small articles, such as ball markers.

BRIEF DESCRIPTION OF SEVERAL VIEWS OF DRAWINGS

DETAILED DESCRIPTION

Figure 1:
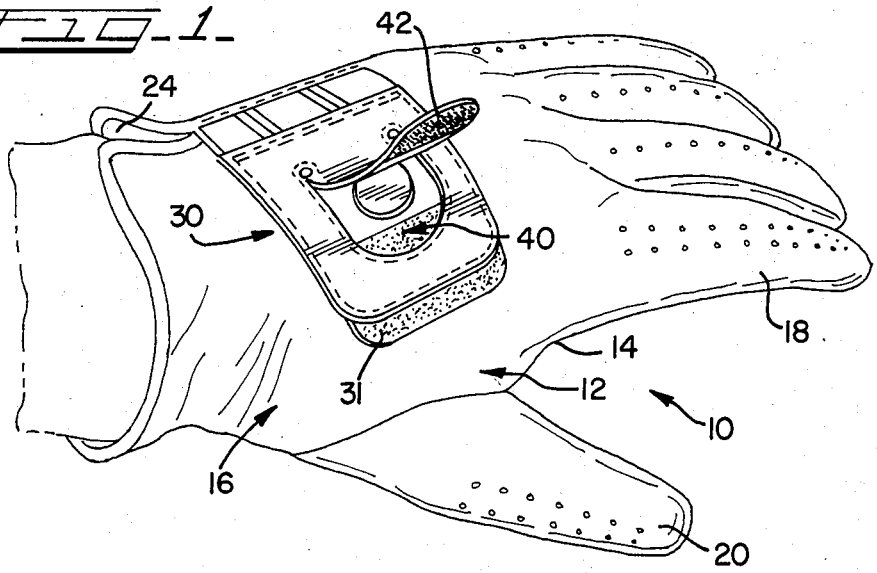
FIG. 1 is a perspective view of a golf glove having the present invention incorporated therein with certain parts deleted.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiment illustrated.

The golf glove of the present invention is generally designated by reference numeral 10 in the drawings, and includes a main body 12 that has a lower palm portion 14 and an upper back portion 16 with the main body having openings for fingers surrounded by finger extensions or sheaths 18, as well as a thumb sheath 20.

The back portion 14 of the glove generally has a slit 24 extending from an edge thereof to divide the back portion into segments or sections 26 and 28. The first and second segments or sections 26 and 28 are adapted to be separated so that the glove can easily be placed on a user's hand and incorporate fastener means or flap (generally designated by reference numeral 30) that attaches to looped element 31 that can be utilized to maintain the glove on the user's hand during play of the game. The palm portion 14 of the glove defines a non-skid gripping surface for gripping the club to prevent inadvertent slippage of the club in the hand during the swing.

As indicated above, the use of "Velcro®" fasteners as the fastening means for the interconnection of the segments of the back portion of the glove has become very common and, thus, has replaced to a large measure the conventional snap-fastener that heretofore was very popular and one which also made it easy to incorporate a ball marker into the glove.

Figure 2:
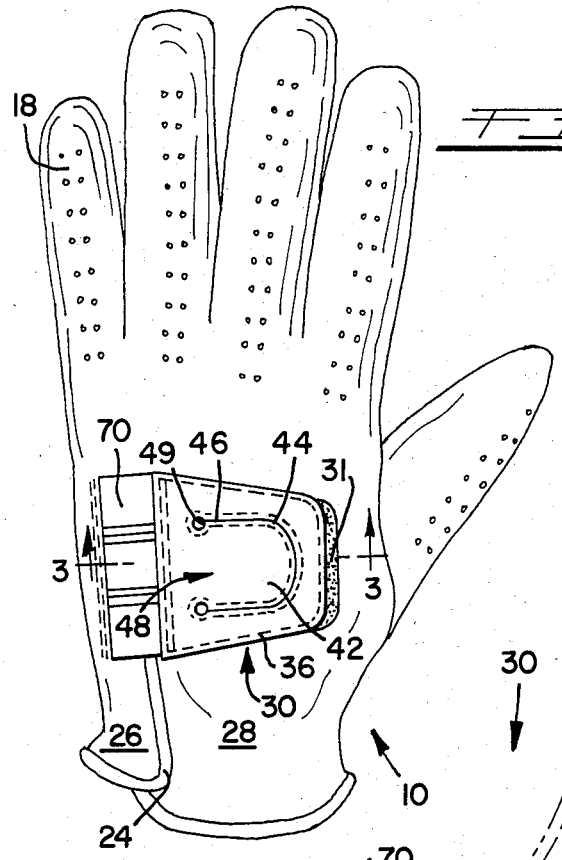
FIG. 2 is a plan view of the glove shown in FIG. 1.

According to the present invention, the fastener means or flap 30 includes a first or lower layer 32 and a second or upper layer 34 which are peripherally connected by an interconnection, such as a stitch 36, as will be explained later. Thus, the two layers cooperate to define a pocket, generally designated by reference numeral 40 (FIG. 1). The pocket is accessible through a closure 42 which is defined by and is an integral part of the upper layer 34. Thus, as shown in FIG. 2, the closure 42 is defined by a substantially C-shaped cut 44 extending through the upper or second layer 34 and the cut terminates in opposite ends 46 which define an integral hinge 48 therebetween. The integral hinge thus is a part of the upper or second layer 34 so that the closure can easily be manipulated between open and closed positions, respectively shown by the solid and dotted line positions of FIG. 3.

According to one aspect of the invention, the upper layer has enlargements or cut-outs 49 extending from opposite ends 46 of cut or cut-out 44 to produce a hinge 48 that has increased flexibility.

Figure 3:
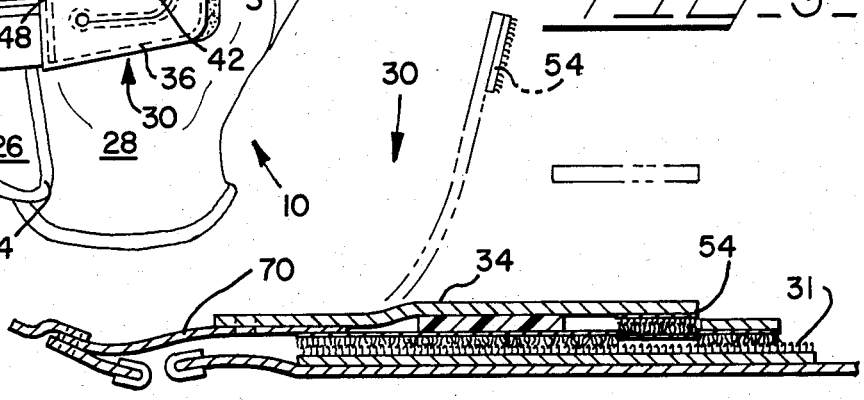
FIG. 3 is a cross-sectional view as viewed along line 3—3 of FIG. 1; and, FIGS. 4–7 show the different stages of producing the fastener flap of the present invention.

Preferably, the closure 42 has a fastener means extending along one edge thereof for fastening the closure along the closed position and yet allowing for easy access into the pocket without any delay. Thus, as shown in FIG. 3, the lower surface of the closure 42 has a fastener element 54, such as a Velcro® material, on an edge thereof opposite the integral hinge which overlies and is aligned with a second fastener element 56 attached to the upper surface of the lower or first layer 32 of the flap 30. Since the fastener elements 54 and 56 are the well-known, commercially available Velcro® fasteners, these fasteners can be attached and separated merely by gripping the edge of the closure or pushing on the exposed surface of the closure to open or close and gain access to the pocket 40, defined between the layers 32 and 34.

Thus, the pocket 40 can easily be exposed for inserting a ball marker 60, which may be in the form of a circular molded plastic disk with or without a projection thereon. Therefore, during normal play, the ball marker 60 remains located within the pocket 40 and retained therein by the closure 42, particularly the fastener elements 54 and 56. When the golfer reaches a green, and needs to mark the ball, it is only necessary to grip the free edge of the closure 42 and separate the fasteners 54, 56 to expose the marker 60, which can then be removed from the pocket and placed in position. This can all be done without any delay or annoyance in attempting to locate the marker. After putting has been completed, the marker can be inserted back into the pocket 40 and the closure 42 will retain the marker therein until further need arises.

According to a further aspect of the invention, the fastener means or flap 30 (FIG. 3) is preferably connected to the remainder of the glove body through an elastic connection, such as an elastic member 70, which has one edge connected to an overlapping portion 72 of the golf glove and an opposite edge extending between the layers 32 and 34 and connected thereto through the stitching 36. Thus, the elastic material will accommodate some give of the back portion segments 26 and 28 during normal manipulation of the hand to maintain a comfortable fit of the golf glove on the user's hand.

Figure 4:
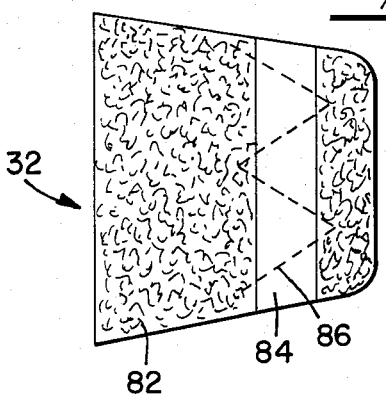

FIGS. 4–7 show the steps of forming the closure member having the marker pocket formed therein in a simplified fashion using a minimum amount of material. As shown in FIG. 4, the lower layer 32 of flap 30 is formed from a fluffy piece or segment 82 that is cut to a generally trapazoidal configuration. A small intermediate strip or portion 84 is cut from the segment 82 of fluffy material forming hooks and reversed and is attached to the remainder of the segment through a reinforcing stitch 86 so that the fluffy surface of strip 84 is exposed on the back side, as viewed in FIG. 4.

Figure 5:
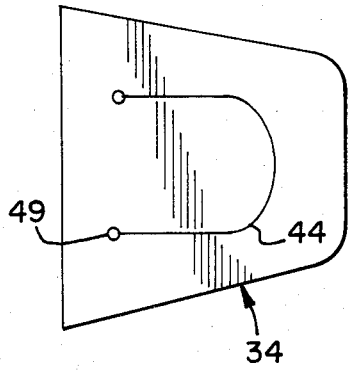

The next step is the formation of the upper layer 34 of flap 30. As shown in FIG. 5, a generally trapazoidal piece of material of the same configuration as lower layer 32 (FIG. 4) is first cut along a C-shaped or U-shaped line 44, as shown in FIG. 5. If desired, circular holes 49 may simultaneously be made at the ends of cut 44 A small segment of material 54 (FIG. 6) having loops may then be glued or otherwise secured to the free end of cover 42 formed by cut line 44, as shown in FIG. 6.

Figure 6:
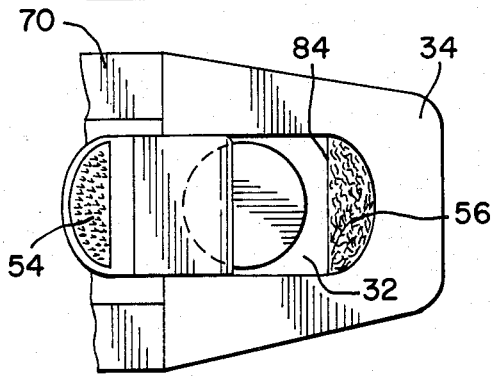

The lower and upper layers 32 and 34 are then placed in overlapping relation to each other, as shown in FIG. 6, so that the fluffy surface of strip 84 is exposed within the opening in the upper layer created by the cut line 44 while the remainder of the fluffy surface of segment 82 is exposed below the upper layer 34. At the same time, elastic member 70 is inserted between the layers to the position shown in FIG. 6.

The upper and lower layers are then interconnected to each other and to elastic member 70 with peripheral stitch 36. A further stitch 92 may be added as an additional connection and reinfocement between layers 32, 34 and elastic member 70. Also, a reinforcing stitch 94 may be provided around cover or closure 42 and layer 34 may be connected to layer 32 by a further stich 96 along line 44, if desired.

Figure 7:
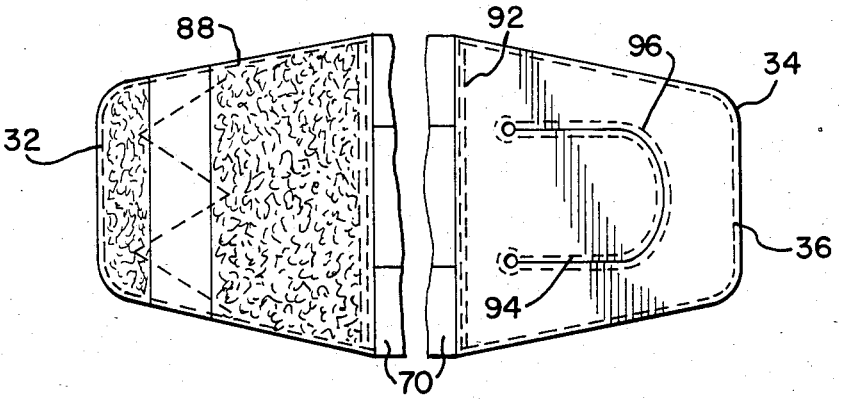

FIG. 7 shows the two interconnected layers in projected view of the two layers, while FIG. 6 shows the same overlapping layers with the stitching deleted for purposes of clarity.

Thus, it will be seen that the flap with the pocket can be formed with essentially the same material as flaps that are presently used as part of the Velcro® fastener system formed on most golf gloves. It should be noted that the reversed strip 84 is positioned to be aligned with the opening in the upper layer to be exposed to the looped fastener element 54 on the cover 42 and forms the Velcro® fastener for the cover, while the remainder of the segment 82 cooperates with looped element 31 to provide the Velcro® fastener for the glove.

The resultant flap 30, the majority of segment 82 of first layer 32 defines a conventional Velcro® fastener element which cooperates with a separate Velcro® fastener element 31 that is attached to the exposed surface of the second back portion segment 28, as illustrated in FIG. 3. Thus, the flap or fastener means 30 can easily be separated for removal of the glove while the cover 42 retains the ball marker 60 within the pocket 40 through strip or material 84 with hooks and looped element 54.

Of course, various modifications come to mind without departing from the spirit of the invention. For example, the interconnection 72 of the elastic material can easily be placed into the overlapping portion of the glove palm portion and the glove back portion since the entire glove is usually formed into two mirror-image halves which are peripherally interconnected to form the main body, including the finger sheaths 18 and the thumb sheaths 20. Thus, with only a minor modification of the closure flap for a conventional golf glove, the manufacturer can incorporate the ball marker retaining means into each glove at minimum additional cost or tooling.

Of course, if desired, the marker retainer need not necessarily be formed as part of the fastener flap, but could also be formed as an overlying layer to the back portion 16 of the glove, particularly when the glove fastener means is in the form of snap-fasteners. In this instance, the first or lower layer 32 could be the main layer of the main body 12 and the upper layer 34 could be stitched thereto using the peripheral stitch 36 so that the pocket would be defined between the main body and the separate layer.

Also, the closure 42 could have a small opening for receiving the projection (not shown) in the event a common marker with a projection is used.

I claim:

1. A golf glove comprising a main body having a palm portion and a back portion along with openings for receiving fingers, said back portion having first and second segments, and fastener means on said back portion including a flap carried by said first segment and a fastener on said second segment for securing said main body to a user's hand, the improvement of means defining a pocket on said flap for a small article, such as a ball marker, and a closure on said flap for covering said pocket to retain said small article therein and openable to expose said small article, said closure having an integral hinge defining a connection with said flap, said flap including inner and outer layers interconnected to each other to define said pocket, and said outer layer having a cut defining said closure for said pocket.

2. A golf glove as defined in claim 1, further including an elastic member connecting said flap to said first segment.

3. A golf glove as defined in claim 2, in which said layers are interconnected by a peripheral stitch with said elastic member extending between said layers and connected thereto by said stitch.

4. A golf glove as defined in claim 1, in which said cut is generally C-shaped in plan view with said integral hinge extending across an open part of the C.

5. A golf glove as defined in claim 4, in which said cut has inward extensions on opposite ends to reduce the length of said integral hinge.

6. A golf glove as defined in claim 1, in which said inner layer is a first part of a Velcro® connector and said fastener is a second part of a Velcro® connector.

7. A golf glove as defined in claim 6, in which said closure has a Velcro® fastener element connectable to a Velcro® fastener element on said inner layer in said pocket.

8. A golf glove comprising a main body having a back portion split into segments with one segment having a flap extending thererom and connectable to an adjacent segment, the improvement of said flap including first and second layers peripherally interconnected to define a pocket therein, said second layer having a cut therein defining a closure for said pocket connected to said second layer by an integral hinge and fastener means on said closure for connection to said first layer.

9. A golf glove as defined in claim 8, in which said cut is C-shaped in plan view and said integral hinge extends across opposite ends of said cut and in which said cut has inward extensions on said opposite ends reducing said integral hinge.

10. A golf glove as defined in claim 8, further including an elastic member connected to said one segment and extending between said layers and connected by the peripheral interconnection.

11. A closure flap for a golf glove comprising lower and upper layers peripherally interconnected, with said lower layer being formed of a material defining hooks as fastener elements, an intermediate portion of said lower layer being reversed to have said hooks exposed on an opposite surface adjacent said upper layer, said upper layer having a cut defining a cover for a pocket which is formed between said layers, said cut intersecting at least a portion of said intermediate portion, and a fastener element on a portion of said cover having loops aligned with said exposed hooks of said intermediate portion for releaseable connection thereto.

12. A closure flap as defined in claim 11, further including an elastic member interposed between an end portion of said layers and connected thereto for connection to a golf glove.

* * * * *